United States Patent [19]

Burnett et al.

[11] 4,112,398

[45] Sep. 5, 1978

[54] TEMPERATURE COMPENSATED MICROWAVE FILTER

[75] Inventors: Gary L. Burnett, Anaheim; George I. Tsuda, Fullerton, both of Calif.

[73] Assignee: Hughes Aircraft Company, Culver City, Calif.

[21] Appl. No.: 712,113

[22] Filed: Aug. 5, 1976

[51] Int. Cl.[2] ..... H01P 7/06; H01P 1/20; H01P 1/30

[52] U.S. Cl. ..... 333/73 R; 333/73 W; 333/73 S; 333/83 T

[58] Field of Search ..... 333/83 BT, 82 BT, 73 W, 333/73 R, 73 S, 73 C, 84 M; 331/117 D, 96, 101; 330/56

[56] References Cited

U.S. PATENT DOCUMENTS

| | | | |
|---|---|---|---|
| 3,348,173 | 10/1967 | Matthaei et al. | 333/73 S |
| 3,601,719 | 8/1971 | Hodgson et al. | 333/73 W X |
| 3,733,567 | 5/1973 | Johnson | 333/82 BT X |
| 3,818,389 | 6/1974 | Fisher | 333/73 R |

*Primary Examiner*—Alfred E. Smith
*Assistant Examiner*—Marvin Nussbaum
*Attorney, Agent, or Firm*—R. A. Cardenas; J. Holtrichter, Jr.; W. H. MacAllister

[57] ABSTRACT

A lightweight microwave filter device is disclosed which utilizes a housing made of a lightweight metal such as aluminum having a relatively large coefficient of thermal expansion. The microwave filter also utilizes resonator elements which are either interdigital or in a comb-line filter arrangement. The resonator rods are made in two segments — a lightweight metal such as aluminum having a relatively large coefficient of thermal expansion and a metal having a very low coefficient of thermal expansion such as invar. As the temperature varies the length of the rod also varies. The tuning capacitance between the rods and the housing varies with temperature changes and compensates for the change in the rod length. Thus the resonant frequency of the microwave filter is maintained relatively constant over a predetermined temperature range.

7 Claims, 4 Drawing Figures

TEMPERATURE COMPENSATED MICROWAVE FILTER

BACKGROUND OF THE INVENTION

1. Field of the Invention

This invention relates generally to microwave devices and in particular this invention relates to a lightweight distributed parameter microwave filter having resonator rods made of a combination of a metal having an extremely small coefficient of thermal expansion and a lightweight metal alloy which are housed in a lightweight metal housing.

2. Description of the Prior Art

Microwave filters utilizing resonator rods are well known in the prior art. Both interdigitated resonant rod and "comb-line" resonant rod arrangements have been used. The resonant frequency of a housing may be changed by changing the capacitance or the inductance of a resonant element. A housing made of a metal having a relatively large coefficient of thermal expansion would cause a large change in the resonant frequency as the ambient temperature changes. And, a housing made of metal having a relatively small coefficient of thermal expansion would not cause the resonant frequency to change greatly as a result of the ambient temperature change. Similarly, a resonant element having a relatively high coefficient of thermal expansion would cause a significant shift in resonant frequency if the rod is subjected to widely varying ambient temperature. The end of the resonator element and the interior housing wall provide a tuning capacitance. If the spacing between the resonator element and the housing changes due to different coefficients of thermal expansion, so too, does the resonant frequency change. Thus, as the rod changes in length and as the tuning capacitance changes the resonant frequency also changes. Therefore, the resonant frequency is dependent upon the coefficient of thermal expansion.

Generally, for wide temperature applications invar, a combination of nickel and iron, is used for the resonant rods and the housing because of its extremely low coefficient of thermal expansion which is $1 \times 10^{-6}$in/in/° C. The dimensions of an invar housing and the length of the resonator rods located therein are constant and the filter provides a very stable output frequency over a broad temperature range due to the low coefficient of thermal expansion. On the other hand, aluminum has a relatively high coefficient of thermal expansion of $22 \times 10^{-6}$ in/in/°C. A variance in ambient temperature would cause a relatively large variation in the dimensions of an aluminum microwave housing and the length of the resonator rod resulting in a relatively large frequency shift.

Using materials having a coefficient of thermal expansion which is greater than invar causes the output bandpass frequency to shift as the filter experiences dimensional changes as a result of temperature fluctuations. As the housing changes in size so does the resonant frequency. As the reactive rods change in size as a result of temperature variations so does their resonance change. Also, the capacitance between the walls of the housing and the reactive rods change. Thus, the thermal expansion and contraction of materials with relatively higher coefficient of thermal expansion causes several mechanisms to affect the resonant frequency of the filter.

It is not always practical nor efficient to use filters made of invar in space applications because of the relatively high weight of such a device. On the other hand, a microwave filter utilizing only a lightweight metal such as aluminum has the disadvantage of frequency shift with temperature change.

A more detailed discussion of microwave filters may be found in "Principles and Applications of Waveguide Transmission" by George C. Southworth at pages 285 to 306.

SUMMARY OF THE INVENTION

Accordingly, it is an object of the present invention to provide a microwave device that is lightweight and relatively inexpensive.

It is another object of the present invention to provide a lightweight microwave device having a frequency response that is constant over a predetermined temperature range.

In accordance with the foregoing objects, a filter device includes a housing made of a lightweight metal alloy material. The filter further includes a resonant rod made of two metal alloys having a predetermined length and disposed in the housing. The resonant rod is in two segments, the first segment being a lightweight metal alloy and the second segment being made of a metal alloy having a small coefficient of thermal expansion. The relationship of the lengths of the two segments is determined by the coefficients of thermal expansion of the two metals such that the capacitance changes between the resonant rod and the housing wall compensates for the resonant frequency change of the resonant rod thereby maintaining the resonant frequency response of the filter constant.

BRIEF DESCRIPTION OF THE DRAWINGS

FIG. 1 illustrates a microwave bandpass filter 10 having a housing 11 that is made of a lightweight metal alloy such as aluminum 6061-T6. The housing 11 includes a chassis 12, a bottom cover 13 and end plates 14 and 15. Utilizing an aluminum housing instead of an invar housing reduces the weight of the filter to approximately $\frac{1}{3}$. Magnesium may also be used.

Figure 1:
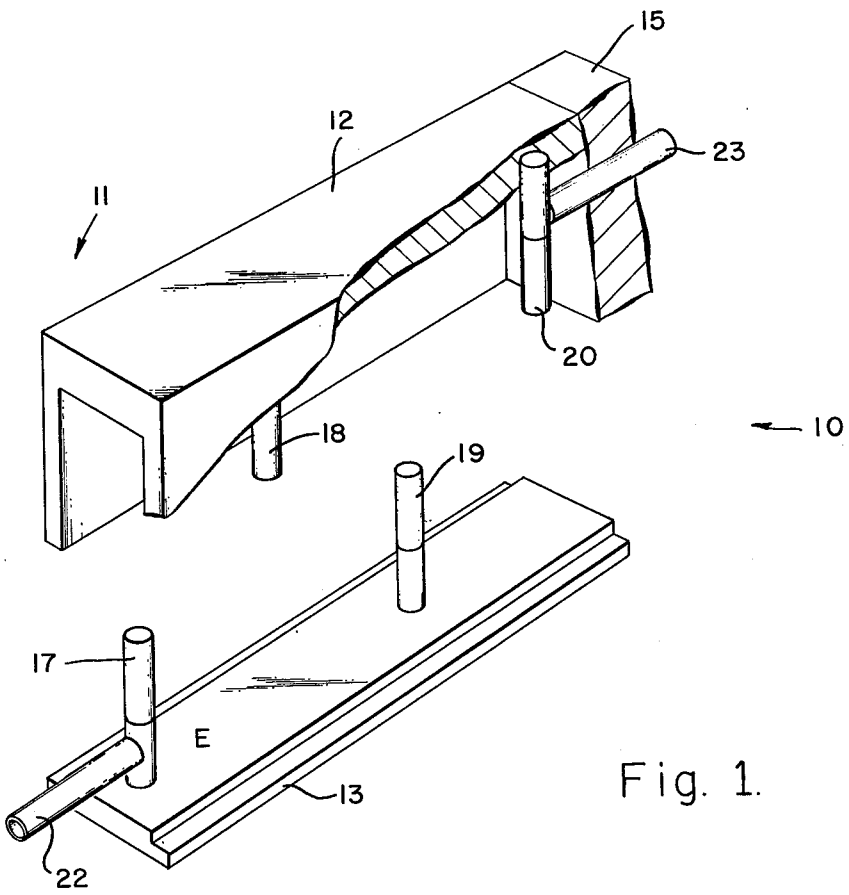
FIG. 1 illustrates a microwave filter according to an embodiment of the present invention.

Included within the housing 11 is a set of four interdigitated resonant elements or rods 17, 18, 19, and 20. An input port 22 connected to the first rod 17 and an output port 73 is connected to the last rod 20. The length of each rod is slightly less than $\frac{1}{4}$ of a wavelength. The space between the end of each rod and the housing 11 wall is electrically a tuning capacitor. The reactive rods 17–20 are oriented across the electrical field ($\overline{E}$) and between two parallel ground planes 25 and 26 which may be any distance consistent with interdigital filter design. The distance between the housing 11 walls that are perpendicular to the $\overline{E}$ field is chosen to be $\frac{1}{4}$ wavelength of the resonant frequency. The diameter of each resonant rod and the distance between rods is chosen according to the desired bandwidth characteristics of the filter.

Pursuant to the present invention, the reactive rods 17–20 each consist of two sections, one section is of a metal alloy having a low coefficient of thermal expansion such as invar, for example. The other section is made of a lightweight metal alloy such as aluminum which has a relatively higher coefficient of thermal expansion but is much lighter in weight than invar. Notwithstanding the fact that aluminum has a relatively high coefficient of expansion, choosing the proper ratio of segment lengths results in highly stable resonant frequency that is temperature compensated.

Figure 2:
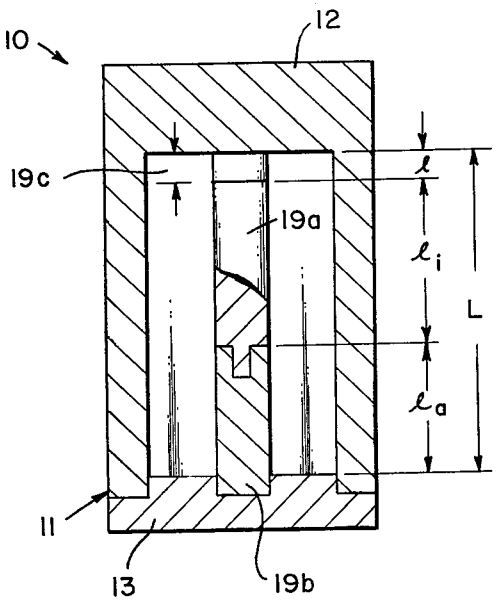
FIG. 2 is a cross-sectional view of the embodiment according to FIG. 1.

Referring now to FIG. 2, the cross section of FIG. 1 illustrates a typical resonant element 19. The rod 19 includes an invar segment 19*a* and an aluminum segment 19*b*. The ratio of lengths of the segments is approximately 1:1 in the present application. The two segments may be joined in any convenient manner such as a pin and socket arrangement shown in the figure. Generally, the interior parts of the filter are either copper or silver plated which also allows soldering the two segments together. The reference designator 19*c* refers to the space or electrical capacitance between the rod 19 and the housing 12 interior wall.

The resonant frequencies of the microwave filter depend upon several variables including the dimensions of the housing and the length of the resonator rod. The bandwidth depends upon the spacing between the resonator rods. These various dimensions in turn depend upon the ambient temperature and the coefficients of thermal expansion.

The lengths of the aluminum and invar segments of a resonator rod may be approximated by using the resonance formula:

$$\omega_o\left[\frac{K}{L-(l_i+l_a)}+\frac{Y_o l_i+l_a}{c'}\right]=\frac{Y_o \Pi}{2}$$

where:

$c'$ = velocity of light in a vacuum $l_a$ = length of aluminum portion of resonator rod at temperature To $l_i$ = length of invar portion of resonator rod at temperature To $L$ = width of cavity (nominally λo/4)

$C_a$ = coefficient of thermal expansion of aluminum $C_i$ = coefficient of thermal expansion of invar $K$ = constant $Y_o$ = resonator admittance The lengths of the rod segments $l_{io}$ and $l_{ao}$ are experimentally determined for providing the proper operating frequency $\omega_o$. Then the constant $K$ is determined by substituting $l_{io}$ and $l_{ao}$ for $l_i$ and $l_a$ respectively giving:

$$K=\left[\frac{Y_o}{2\omega_o}-\frac{Y_o(l_{io}+l_{ao})}{c'}\right]\left[\frac{L-(l_{io}+l_{ao})}{}\right]$$

The operating frequency $\omega_o$ at some other operating temperature $T=To+\Delta T$ is taken into consideration in:

$$\omega_o=\frac{Y_o \Pi}{2}\Big/\left\{\frac{K}{L_o+L_oC_a\Delta T-(l_{io}+l_{io}C_i\Delta T)-(l+lC_a\Delta T}\right.$$

-continued $$\left.+\frac{Y_o}{c'}(l_{io}+l_{io}C_i\Delta T+l_{ao}+l_{ao}C_a\Delta T)\right\}$$

Then $l_{io}$ and $l_{ao}$ are experimentally chosen in order that $\omega_o$ remains relatively constant over the operating temperature range $T_o+\Delta T$.

Microwave filters utilizing the principles of the present invention have been built and tested. One such device was a four resonator interdigital Tchebyscheff filter with a 0.01dB ripple centered at 1640.5 MHz. with a 4.0 MHz. ripple bandwidth. The interior width of the filter is a quarter wavelength at 1460.5 MHz. or 1.799 inches, i.e., perpendicular to the $\overline{E}$ field. The ground plane spacing is 0.500 inch. The diameter of the resonator rods is a 0.187 inches while the total length of each rod is 1.649. The capacitive gap between the rod ends and the housing is 0.15 inch. The length of the housing is 2.219 inches.

The housing 11 was made of 6061-T6 aluminum alloy having a coefficient of thermal expansion of $22\times10^{-6}$in/in/° C. The composite rods were made of 6061-T6 aluminum and invar in a ratio of 1:1 which is a close approximation of the above equations. The rods and housing were silver plated and assembled together by soldering.

According to the invention the change in the resonant frequency due to the change in length of the resonator rod can be compensated by the corresponding change in the tuning capacitance.

Figure 3:
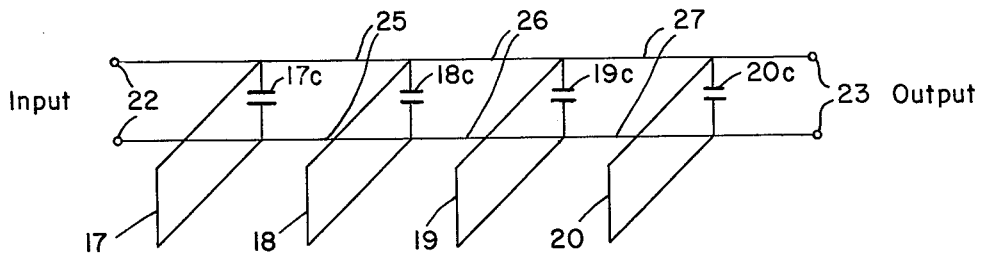
FIG. 3 is a schematic circuit diagram of an interdigitated microwave filter according to FIG. 1.

Referring briefly to FIG. 3, the schematic circuit diagram illustrates the transmission line equivalent circuit of an interdigital filter according to FIG. 1. The resonator rods and the electromagnetic coupling therebetween are represented by the short circuited shunt stub transmission lines identified as 17–20 and 25–27. The spaces between the resonator rods and the interior wall of the housing is represented by the shunt capacitances 17*c*–20*c*. The exact change in both resonator length and tuning capacitance is determined by the ratio of the aluminum to invar lengths. The exact ratio of the lengths may also be empirically determined based upon the desired resonant frequency.

Figure 4:
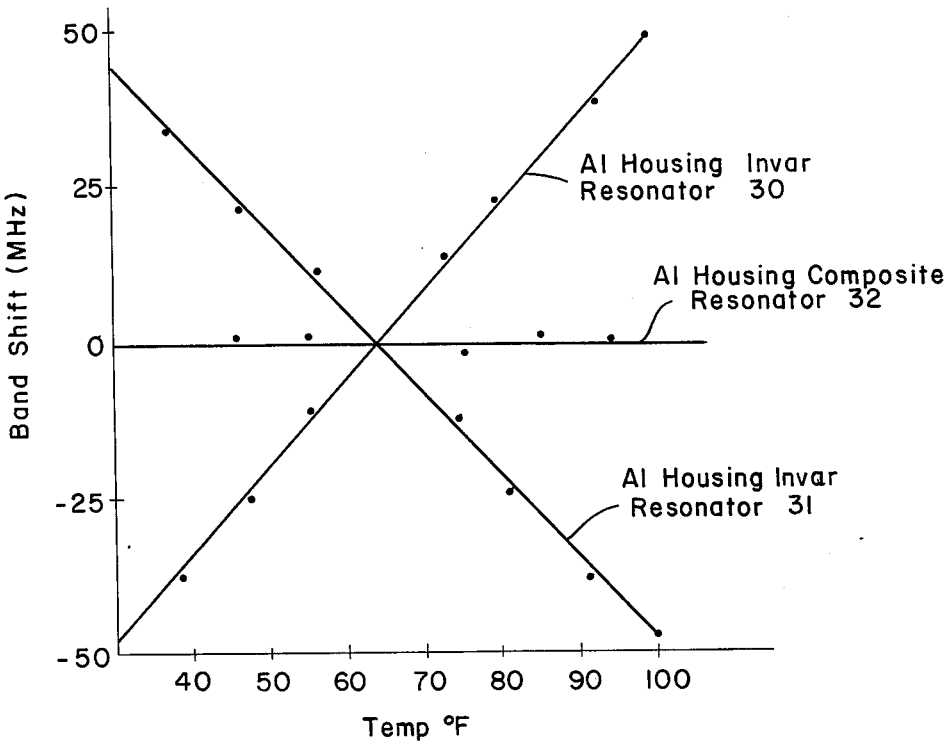
FIG. 4 is a graph diagram representing the bandshift of various microwave filters made of several metals as a result of ambient temperature changes.

Referring now to FIG. 4, the graph illustrates the frequency variation of an interdigital filter with various combinations of aluminum and invar resonators in an aluminum housing. The abscissa represents temperature in degrees Fahrenheit while the ordinate axis represents the bandshift in MHz. as a result of temperature changes of the microwave filter. The positive sloped line 30 illustrates an aluminum housing and invar resonator rods. The negative sloped line 31 illustrates an aluminum housing and aluminum resonator rods. The horizontal line 32 illustrates the resonant frequency bandshift of an aluminum resonator cavity and composite aluminum invar resonator rods. It can be seen from the curves 30 and 31 that the resonant frequencies are greatly affected by the coefficients of the thermal expansion. However, utilizing the principles of the present invention it can be seen that over a broad temperature range, there is a very slight shift in resonant frequency.

Although the present invention has been shown and described with reference to particular embodiments, nevertheless, various changes and modifications obvious to one skilled in the art to which the invention pertains are deemed within the purview of the invention.

What is claimed is:

1. A lightweight microwave filter having temperature compensation for providing stable resonant frequencies in response to temperature changes, comprising:

a housing being of a lightweight metal alloy having a first coefficient of thermal expansion; and a fixed resonator rod for providing a resonant frequency disposed within said housing, said resonator rod being segmented, a first cylindrically shaped segment being of said lightweight metal alloy, a second cylindrically shaped segment being a metal alloy having a coefficient of thermal expansion being smaller than said first coefficient of thermal expansion, said first and second segments being axially mounted together, said resonator rod and said housing providing a tuning capacitance therebetween depending upon the variance in relative length of said resonator rod and said housing, the lengths of said first and second segments being determined such that the variation in tuning capacitance between the end of said resonant rod and said housing compensates for the resonant frequency shift due to thermal expansion of said resonator rod so that said resonant frequency remains relatively constant.

2. The invention according to claim 1 wherein said metal alloy of said second segment is a ferrous alloy having a relatively small coefficient of thermal expansion.

3. The invention according to claim 2 wherein said ferrous alloy has a coefficient of thermal expansion of $1 \times 10^{-6}$ inches/inch/degree Fahrenheit.

4. A lightweight microwave filter having temperature compensation, comprising:

a housing being of a lightweight metal alloy having a first coefficient of thermal expansion;

input means;

output means; and a plurality of fixed resonator rods having a resonant frequency being disposed within said housing, selected ones of said resonant rods being coupled to said input means and said output means, each of said resonator rods being segmented, a first cylindrical segment being of said lightweight metal alloy and having a first length, a second cylindrical segment being a metal alloy having a coefficient of thermal expansion being smaller than said first coefficient of thermal expansion and having a second length, each of said resonator rods and said housing providing a tuning capacitance therebetween, said capacitance varying in response to the thermal expansion of the respective lengths of said resonator rods for compensating the shift in resonant frequency due to change in lengths of said resonator rods.

5. The invention according to claim 4 wherein said lightweight metal alloy is selected from the group consisting of aluminum and magnesium.

6. The invention according to claim 4 wherein said metal alloy of said second segment is a ferrous alloy having a relatively small coefficient of thermal expansion.

7. The invention according to claim 4 wherein said ferrous alloy has a coefficient of thermal expansion of $1 \times 10^{-6}$ inches/inch/degree Fahrenheit.

* * * * *